US011035031B2

(12) United States Patent
Simanzhenkov et al.

(10) Patent No.: US 11,035,031 B2
(45) Date of Patent: Jun. 15, 2021

(54) PROTECTIVE SURFACE ON STAINLESS STEEL

(71) Applicants: NOVA Chemicals Corporation, Calgary (CA); Kubota Corporation, Osaka (JP)

(72) Inventors: Vasily Simanzhenkov, Calgary (CA); Hany Farag, Calgary (CA); Leslie Benum, Red Deer (CA); Billy Santos, Calgary (CA); Kathleen Donnelly, Calgary (CA); Nobuyuki Sakamoto, Osaka (JP); Kunihide Hashimoto, Osaka (JP); Michael Gyorffy, Orillia (CA)

(73) Assignee: NOVA Chemicals (International) S.A., Fribourg (CH)

( * ) Notice: Subject to any disclaimer, the term of this patent is extended or adjusted under 35 U.S.C. 154(b) by 293 days.

(21) Appl. No.: 16/136,768

(22) Filed: Sep. 20, 2018

(65) Prior Publication Data

US 2019/0100833 A1 Apr. 4, 2019

(30) Foreign Application Priority Data

Oct. 4, 2017 (CA) ..... CA 2981416

(51) Int. Cl.

| | |
|---|---|
| ***C22C 38/08*** | (2006.01) |
| ***C22C 19/05*** | (2006.01) |
| ***C23C 8/18*** | (2006.01) |
| ***C23C 8/02*** | (2006.01) |
| ***F28F 19/06*** | (2006.01) |
| ***C22C 30/00*** | (2006.01) |
| ***C21D 1/72*** | (2006.01) |
| ***F28F 1/12*** | (2006.01) |
| ***C21D 6/00*** | (2006.01) |
| ***F28F 1/26*** | (2006.01) |
| ***C10G 9/16*** | (2006.01) |

(Continued)

(52) U.S. Cl.

CPC ..... *C23C 8/18* (2013.01); *C10G 9/16* (2013.01); *C10G 9/203* (2013.01); *C21D 1/72* (2013.01); *C21D 6/004* (2013.01); *C22C 19/05* (2013.01); *C22C 19/053* (2013.01); *C22C 19/058* (2013.01); *C22C 30/00* (2013.01); *C23C 8/02* (2013.01); *C23C 8/14* (2013.01); *F28F 1/12* (2013.01); *F28F 1/26* (2013.01); *F28F 1/40* (2013.01); *F28F 19/06* (2013.01); *F28F 21/083* (2013.01)

(58) Field of Classification Search

CPC . C22C 19/03; C22C 19/05–058; C22C 38/08; C22C 38/18; C22C 38/40

See application file for complete search history.

(56) References Cited

U.S. PATENT DOCUMENTS

| | | | |
|---|---|---|---|
| 3,864,093 | A | 2/1975 | Wolfla |
| 5,950,718 | A | 9/1999 | Sugitani et al. |

(Continued)

FOREIGN PATENT DOCUMENTS

| | | | |
|---|---|---|---|
| GB | 2 159 542 | A | 12/1985 |

*Primary Examiner* — Lois L Zheng

(74) *Attorney, Agent, or Firm* — Thomas Styslinger

(57) ABSTRACT

A substrate steel of the comprising from 0.01 to 0.60 wt. % of La, from 0.0 to 0.65 wt. % of Ce; from 0.06 to 1.8 wt. % of Nb up to 2.5 wt. % of one or more trace elements and carbon and silicon may be treated in an oxidizing atmosphere to product a coke resistant surface coating of $MnCr_2O_4$ having a thickness up to 5 microns.

18 Claims, 2 Drawing Sheets

(51) Int. Cl.

| | |
|---|---|
| ***C10G 9/20*** | (2006.01) |
| ***C23C 8/14*** | (2006.01) |
| ***F28F 1/40*** | (2006.01) |
| ***F28F 21/08*** | (2006.01) |
| *C22C 38/18* | (2006.01) |
| *C22C 38/40* | (2006.01) |
| *C22C 19/03* | (2006.01) |

(56) References Cited

U.S. PATENT DOCUMENTS

| | | | |
|---|---|---|---|
| 6,899,966 | B2 | 5/2005 | Benum et al. |
| 7,396,597 | B2 | 7/2008 | Nishiyama et al. |
| 8,790,602 | B2 | 7/2014 | Petela et al. |
| 8,906,822 | B2 | 12/2014 | Petrone et al. |
| 9,132,409 | B2 | 9/2015 | Petela et al. |
| 2005/0257857 | A1 | 11/2005 | Benum et al. |
| 2010/0034690 | A1 | 2/2010 | Nishiyama et al. |

PROTECTIVE SURFACE ON STAINLESS STEEL

The present disclosure relates to improved coating on stainless steel. The surface is resistant to coking in applications where it is exposed to hydrocarbons at elevated temperatures. The surface is thinner than many of the low coking steels available and has improved stability. The underlying steel is a modified stainless steel.

There is significant art in the name of Benum assigned to NOVA Chemicals (International) S.A. relating to low coking surfaces on stainless steels. Illustrative of the art is U.S. Pat. No. 6,899,966 issued May 31, 2005. Typically, the surface on the stainless steel comprises a mixture of oxides of $MnCr_2O_4$, $MnSiO_3$, and $Mn_2SiO_4$. The cover oxide layer has a thickness of at least about 1 micron (US2005/0257857). The substrate steel of the present disclosure comprises from 0.20 to 0.60 wt. % of La, from 0.0 to 0.65 wt. % of Ce; from 0.06 to 1.8 wt. % of Nb up to 2.5 wt. % of one or more trace elements and carbon and silicon which are absent from the substrate in the above noted patents.

U.S. Pat. No. 8,906,822 issued Dec. 9, 2014 to Petrone et al., assigned to BASF Qtech Inc. teaches a protective coating on a stainless steel surface where there is a first region comprising $Mn_xO_y$, $MnCr_2O$, or combinations thereof where x and y are integers between 1 and 7, and a second region comprising tungsten. The tungsten component is absent from the surface of the present disclosure.

U.S. Pat. No. 7,396,597 issued Jul. 8, 2008, and U.S. Published Application No. 2010/0034690 published Feb. 11, 2010 both in the name of Nishiyama et al., assigned to Sumitomo Metal Industries, Ltd. are of interest. The 597 patents teaches a stainless steel having a Cr depleted layer. The layer is produced by removing an oxide scale layer produced by heating the base metal. This teaches against the substance of the present disclosure which maintains the surface oxide layer. The 690 application teaches a metal substrate which comprises 0.5 to 5 wt. % of Cu which is higher than in the substrates described herein. Further the steel of the 690 application does not appear to have an oxide coating.

Embodiment 10 of GB 2 159 542 published Dec. 4, 1985 assigned to Man Maschinenfabrick Augsburg Nurnberg teaches producing a felt like surface coating of $MnCr_2O_4$ having a thickness from 1 to 2 microns and below that a dense layer of $Cr_2O_3$ about 4 microns which penetrated into the grain boundary for the $MnCr_2O_4$ surface layer. The substrate alloy comprises about 20 wt. % Cr, about 33 wt. % Ni, 4 wt. % Mn, less than 1 wt. % Si, less than 1 wt. % Ti less than 1 wt. % of Al and the balance iron. The reference also teaches the coated substrate is resistant to further oxidation. The alloy of the present disclosure is distinct from that of the reference.

In some embodiments, the present disclosure seeks to provide a steel substrate with an overcoat having improved resistance to the formation of coke.

In some embodiments, the present disclosure provides a steel substrate comprising from 40 to 55 wt. % Ni, from 30 to 35 wt. % of Cr, from 15 to 25 wt. % Fe, from 1.0 to 2.0 wt. % of Mn, from 0.01 to 0.60 wt % of La, from 0.0 to 0.65 wt. % of Ce; from 0.06 to 1.8 wt. % of Nb and one or more trace elements and carbon and silicon having on its surface an outer layer comprising a spinel of the formula:

$$Mn_xCr_{3-x}O_4$$

wherein x is from 0.5 to 2 having a thickness from 1.5 to 4.0 microns thick and an intermediate layer between the surface layer and the substrate comprising $Cr_2O_3$ having a thickness from 1 to 1.7 microns.

In a further embodiment, the steel substrate further comprises from 0.4 to 0.6, in some embodiments from 0.4 to 0.5 wt. % C, less than 1.5, in some embodiments less than 1.2 wt. % Si, from 0.01 to 0.20 wt. % of Ti, from 0.05 to 0.25, in some embodiments from 0.05 to 0.12 wt. % of Mo, and less than 0.25, in some embodiments less than 0.1, in further embodiments less than 0.06 wt. % Cu.

In a further embodiment, the steel substrate comprises an outer layer and the intermediate layer covering not less than 85% of the surface of the substrate layer.

In a further embodiment, the steel the outer layer and the intermediate layer cover not less than 95% of the surface of the substrate layer.

In a further embodiment, in the outer layer x is from 0.8 to 1.2.

In a further embodiment, the outer layer has a thickness from 1.5 to 2.0 microns and the intermediate layer has a thickness from 1.0 to 1.7 microns.

In a further embodiment, the outer layer consists essentially of $MnCr_2O_4$.

In a further embodiment, there is provided a fabricated part comprising the above steel having at least one surface having the outer and intermediate layer.

In a further embodiment, there is provided a tube (pipe or pass) having the outer and intermediate layer on its internal surface.

In a further embodiment, there is provided a reactor having the outer and intermediate layer on its internal surface.

In a further embodiment, there is provided a furnace tube as above further comprising on its internal surface one or more (parallel) beads or fins wherein angle of intersection of the fin or bead with the longitudinal tube axis is theta ($\theta$), at a pitch (p) of the fins at S the circumference ($S=\pi D$ where D is the inside diameter of the tube).

In a further embodiment, there is provided a furnace tube as above wherein the internal beads or fins are continuous.

In a further embodiment, there is provided a furnace tube as above wherein the internal beads or fins are discontinuous.

In a further embodiment, there is provided a furnace tube as above wherein the internal beads or fins are discontinuous and the total circular arc length of the fin(s) is $TW=w\times n$ where w is the circular arc length projected on a plane and n is the number of fins on one turn of the helical line.

In a further embodiment, there is provided a furnace tube as above having on its external surface a series of closed protuberances having:

i) a maximum height from 3 to 15% of the coil outer diameter;

ii) a contact surface with a coil, or a base, which area is 0.1%-10% of the coil external cross section area;

iii) a geometrical shape which has a relatively large external surface containing a relatively small volume, chosen from:

a tetrahedron (pyramid with a triangular base and 3 faces that are equilateral triangles);

a Johnson square pyramid (pyramid with a square base and sides which are equilateral triangles);

a pyramid with 4 isosceles triangle sides;

a pyramid with isosceles triangle sides (e.g. if it is a four faced pyramid the base may not be a square it could be a rectangle or a parallelogram);

a section of a sphere (e.g. a hemi sphere or less);
a section of an ellipsoid (e.g. a section through the shape or volume formed when an ellipse is rotated through its major or minor axis);
a section of a tear drop (e.g. a section through the shape or volume formed when a non uniformly deformed ellipsoid is rotated along the axis of deformation);
a section of a parabola (e.g. section through the shape or volume formed when a parabola is rotated about its major axis—a deformed hemi—(or less) sphere), such as e.g. different types of delta-wings.

In a further embodiment, there is provided a furnace tube as above having one or more beads or fins on its internal surface and on its external surface a series of closed protuberances having i) a maximum height from 3 to 15% of the coil outer diameter;
ii) a contact surface with a coil, or a base, which area is 0.1%-10% of the coil external cross section area;
iii) a geometrical shape which has a relatively large external surface containing a relatively small volume, chosen from:

a tetrahedron (pyramid with a triangular base and 3 faces that are equilateral triangles);
a Johnson square pyramid (pyramid with a square base and sides which are equilateral triangles);
a pyramid with 4 isosceles triangle sides;
a pyramid with isosceles triangle sides (e.g., if it is a four faced pyramid the base may not be a square it could be a rectangle or a parallelogram);
a section of a sphere (e.g., a hemi sphere or less);
a section of an ellipsoid (e.g., a section through the shape or volume formed when an ellipse is rotated through its major or minor axis);
a section of a tear drop (e.g., a section through the shape or volume formed when a non uniformly deformed ellipsoid is rotated along the axis of deformation);
a section of a parabola (e.g., section through the shape or volume formed when a parabola is rotated about its major axis—a deformed hemi—(or less) sphere), such as e.g. different types of delta-wings.

In a further embodiment, there is provided a furnace tube having a circular (annular) cross section and on its external surface from 1 to 8 substantially linear longitudinal vertical fins having a triangular cross section said fins having: (i) a length from 10 to 100% of the length of the coil pass; (ii) a base having a width from 3% to 30% of the coil outer diameter, which base has continuous contact with, or is integrally part of the coil pass; (iii) a height from 10% to 50% of the coil outer diameter; (v) a weight from 3% to 45% of the total weight of the coil pass; and (vi) adsorbing more radiant energy than they radiate.

As used herein the term "substantially linear" with respect the longitudinal vertical fins, means having a bend of not more than about 8 degrees, or for example not more than about 5 degrees, along its length.

In a further embodiment, there is provided a furnace tube having a circular (annular) cross section and on its internal surface a bead or a fin as above and on its external surface from 1 to 8 substantially linear longitudinal vertical fins having a triangular cross section said fins having: (i) a length from 10 to 100% of the length of the coil pass; (ii) a base having a width from 3% to 30% of the coil outer diameter, which base has continuous contact with, or is integrally part of the coil pass; (iii) a height from 10% to 50% of the coil outer diameter; (v) a weight from 3% to 45% of the total weight of the coil pass; and (vi) adsorbing more radiant energy than they radiate.

In a further embodiment, there is provided a method to make a surface comprising an outer layer comprising a spinel of the formula:
$Mn_xCr_{3-x}O_4$ wherein x is from 0.5 to 2 having a thickness from 1.5 to 4.0 microns thick; and
an intermediate layer between the surface layer and the substrate comprising $Cr_2O_3$ having a thickness from 1 to 1.7 microns covering at least 85% of a surface of a steel substrate comprising from 40 to 55 wt. % Ni, from 30 to 35 wt. % of Cr, from 15 to 25 wt. % Fe, from 1.0 to 2.0 wt. % of Mn, from 0.01 to 0.60 wt. % of La, from 0.0 to 0.65 wt. % of Ce; from 0.06 to 1.8 wt. % of Nb up to 2.5 wt. % of one or more trace elements and carbon and silicon comprising in an oxidizing atmosphere:

1) heating the steel from room temperature at a rate from 10 to 15° C./min to a temperature from 220° C. to 240° C. and holding the steel at this temperature from 1.5 to 3 hours;
2) heating the steel a rate from 1 to 5° C./min to a temperature from 365 to 375° C.—and holding the steel at this temperature from 1 to 3 hours;
3) heating the steel at a rate from 1 to 5° C./min to 1000° C. to 1100° C. and holding the steel at this temperature for from 4 to 8 hours; and
4) cooling the steel at a rate from 1° C. to 2.5° C. to a temperature from 18 to 25° C.

NUMBERS RANGES

Figure 1:
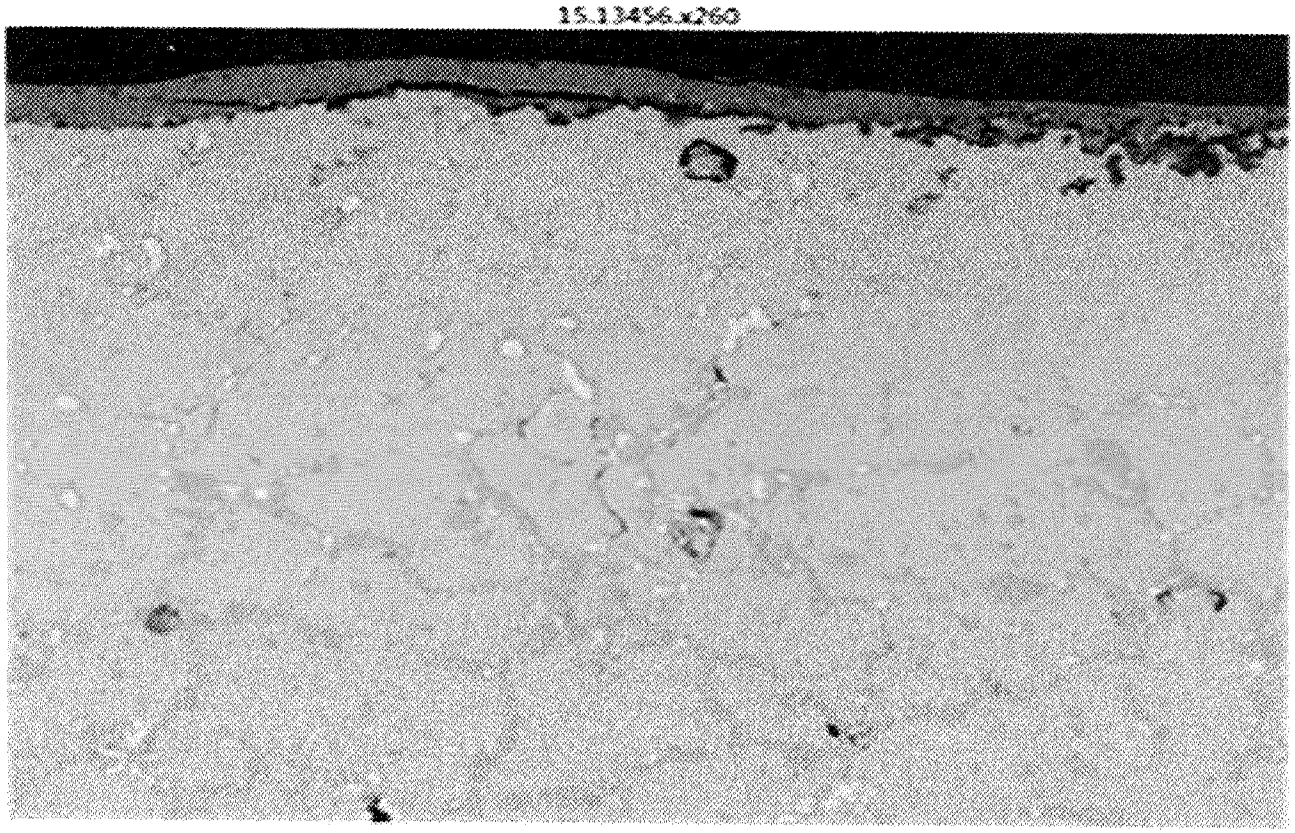
FIG. 1 is a SEM of the cross-section of an outlet tube of the present disclosure after 5 years in operation in an ethylene cracker.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the properties that the present disclosure desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

All compositional ranges expressed herein are limited in total to and do not exceed 100 percent (volume percent or weight percent) in practice. Where multiple components can be present in a composition, the sum of the maximum amounts of each component can exceed 100 percent, with the understanding that, and as those skilled in the art readily understand, that the amounts of the components actually used will conform to the maximum of 100 percent.

The steel substrate disclosed herein comprises from 40 to 55 wt. %, in some embodiments from 40 to 45 wt. % of Ni, from 30 to 35 wt. %, in some embodiments from 33 to 35 wt. % of Cr, from 15 to 25 wt. %, in some embodiments from 20 to 25 wt. % Fe, from 1.0 to 2.0 wt. % of Mn, from 0.01 to 0.60, in some embodiments from 0.20 to 0.60 wt. % of La, from 0.0 to 0.65 wt. % of Ce; from 0.06 to 1.8 wt. % of Nb and one or more trace elements and carbon and silicon. In some embodiments the carbon, silicon and trace elements comprise from 0.4 to 0.6 wt. % C, less than 1.5, in some embodiments less than 1.2 wt. % Si, from 0.01 to 0.20, in some embodiments from 0.10 to 0.20 wt. % of Ti, from 0.05 to 0.25, in some embodiments from 0.05 to 0.15 wt. % of Mo, and Cu less than 0.25, in some embodiments less than 0.06 wt. %. Typically the total weight percent of the carbon, silicon and trace elements ranges from 0.60 to 2.20 wt. %, in some embodiments from 0.7 to 1.5 wt. %.

One method of producing the surfaces disclosed herein is by treating the shaped stainless steel (i.e. part which may have been cold worked prior to treatment) in a process which might be characterized as a heat/soak/cool process.

The process comprises in an oxidizing atmosphere:

1) heating the steel from room temperature at a rate from 10 to 15° C./min in some embodiments from 12 to 14° C./min in the range from 220 to 240° C. in some embodiments from 225 to 235° C. and holding the steel at this temperature from 1.5 to 3 hours or from 2 to 2.5 hours;
2) heating the steel a rate from 1 to 5° C./min in some embodiments from 2 to 3° C./min to from 365 to 375° C., in some embodiments from 370 to 374° C., and holding the steel at this temperature from 1 to 3 hours or from 1 to 2 hours;
3) heating the steel at a rate from 1 to 5° C./min, in some embodiment from 2 to 3° C./min to from 1000 to 1100° C. in some instances from 1050 to 1090° C. holding the steel at this temperature for from 4 to 8 hours, or from 5 to 7 hours;
4) cooling the steel at a rate from 1 to 2.5° C./min to a temperature from 18 to 25° C.

In some embodiments, the oxidizing environment comprises air, in some embodiments, from 40 to 50 weight % of air and the balance one or more inert gases, for example, nitrogen, argon or mixtures thereof.

The cooling rate for the treated stainless steel should be such to prevent spalling of the treated surface. The cooling rate for the steel after the last heat treatment should be less than about 2.5° C. per minute.

Other methods for providing the surface will be apparent to those skilled in the art. For example, the stainless steel could be treated with an appropriate coating process, for example, as disclosed in U.S. Pat. No. 3,864,093.

The outer layer and the intermediate layer cover not less than 85% of the surface of the substrate layer. In some embodiments, the outer layer and the intermediate layer cover not less than 95%, of the surface of the substrate layer. In some embodiments, the outer layer has a thickness from 1.5 to 2.0 microns and the intermediate layer has a thickness from 1.0 to 1.7 microns.

The outer surface on the treated substrate typically comprises not less than 85 wt. %, for example, not less than 90 wt. % of the compound of the formula:

$Mn_xCr_{3-x}O_4$ wherein x is from 0.5 to 2. In some embodiments x may be from 0.8 to 1.2, or for example, x is 1 ($MnCr_2O_4$). In some embodiments the surface comprises not less than 85 wt. %, in some embodiments more than 95 wt. %, of the compound of the formula $Mn_xCr_{3-x}O_4$. Other oxides which may be present in the surface may comprise oxides of Mn, Si chosen from MnO, $MnSiO_3$, $Mn_2SiO_4$ and mixtures thereof. These oxides should be present in amounts of less than 5 wt. %, for example, less than 1 wt. %. The surface layer may comprise up to 5 wt. %, for example, less than 1 wt. % of $Cr_2O_3$ where the $Mn_xCr_{3-x}O_4$ does not completely cover the surface.

Generally, the steel substrate is fabricated into a finished shape such as a tube or pipe, a vessel such as a drum or cylinder, a piston, a valve, etc. One particularly useful fabricated part or shape is a pipe or tube or a furnace pass or coil. Such pipes or tubes may be used in cracking furnaces. The interior of the pipe is treated to produce the surface which is resistant to coking. In some embodiments, his will improve the run length of the tube or pipe in the furnace.

Generally in steam cracking, a feedstock (e.g., a $C_{2-4}$ alkane such as ethane or a higher paraffin such as naphtha) is fed in a gaseous form to a tube, pipe or coil typically having an outside diameter ranging from 1.5 to 8 inches (for example, outside diameters are 2 inches or about 5 cm; 3 inches or about 7.6 cm; 3.5 inches or about 8.9 cm; 6 inches or about 15.2 cm and 7 inches or about 17.8 cm). The tube or pipe runs through a furnace having a cracking section generally maintained at a temperature from about 900° C. to about 1100° C. and the outlet gas generally has a temperature from about 800° C. to about 900° C. As the feedstock passes through the cracking section it releases hydrogen (and other byproducts) and becomes unsaturated (e.g., ethylene). The residence time of the feed passing through the cracking section is short generally less than a tenth of a second and may be as short as milliseconds. The typical operating conditions such as temperature, pressure and flow rates for such processes are well known to those skilled in the art.

Under the above conditions, it is highly desirable to have as great a heat transfer from the furnace into fluid (gas) moving through the interior of the pipe or tube.

In one embodiment, the tube may further comprise an internal surface modification to improve heat transfer such as a helical fin or bead or rifling or a combination thereof on the inside of the tube. One example of an internal spiral rib or bead is described, for example, in U.S. Pat. No. 5,950,718 issued Sep. 14, 1999 to Sugitani et al., assigned to Kubota Corporation. The fins or bead form a helical projection on the tube's inner surface. The angle of intersection of the fin or bead with the longitudinal tube axis is theta (θ), at a pitch (p) of the fins at S the circumference ($S=\pi D$ where D is the inside diameter of the tube). The pitch p of the fin which is formed by a single helical projection or bead is equal to the distance of axial advance of a point in the helical projection for a complete turn about the tube axis, (i.e., lead $L=\pi D/\tan\theta$). The pitch (p) of the helical fin can be optionally determined as the spacing (axial distance) between the adjacent helical projections for the same helical projection (when there are parallel helical projections). Generally, the internal fin(s) may have a height from 1 to 15 mm, a pitch from 20 to 350 mm at an intersection angle (θ) from 15° to 45°, or from 25° to 45°.

The internal fins or beads may be continuous as described above or may be discontinuous.

In the case of a tube having an inside diameter D of about 30 to about 150 mm, for example, the angle of inclination θ can be about 15 to about 85 degrees, and the pitch p, about 20 to about 400 mm. The pitch p is increased or decreased for adjustment depending on the angle of inclination θ of the helix and the number N of helixes (p=E/N wherein E is helix lead).

The height H (the height of projection from the tube inner surface) of the fins is, for example, about one-thirtieth to one-tenth of the inside diameter of the tube. The length L of the fins is, for example, about 5 to about 100 mm, and is determined, for example, according to the inside diameter D of the tube and the number of divided fins along every turn of helical locus.

If a discontinuous fin has a circular arc length (as projected on a plane) w and the number of fins on one turn of helical line is n. The total circular arc length TW of the fins is then TW=w×n.

The proportion of the total circular arc length TW of discontinuous fins to the circumferential length C (C=πD) of the tube inner surface, namely, R (R=TW/C), is, for example, about 0.3 to 0.8 in order to promote a minimized pressure loss while permitting the helical fins to promote heat transfer to the fluid inside the tube. If this value is too small, the effect to promote heat transfer will be lower, whereas if the value is excessively great, an excessive pressure loss will result.

The helical fins can be efficiently formed as beads by an overlaying method such as plasma powder welding (PTA welding).

In a further embodiment, the pipe or tube may have external fins or protuberances to increase the radiant heat taken up by the tube from the furnace walls and burners. These protuberances are described in U.S. Pat. No. 8,790,602 issued Jul. 29, 2014 to Petela et al, assigned to NOVA Chemicals (International) S.A.

In accordance with the present disclosure, the external surface of the coil, at least in a portion of one or more passes in the cracking furnace radiant section, is augmented with relatively small protuberances.

The protuberances may be evenly spaced along the pass or unevenly spaced along the pass. The proximity of the protuberances to each other may change along the length of the pass or the protuberances may be evenly spaced but only on portions of the tube, or both. The protuberances may be more concentrated at the upper end of the pass in the radiant section of the furnace.

The protuberances can cover from 10% to 100% (and all ranges in between) of the external surface of the coil pass. In some embodiments, the protuberances may cover from 40 to 100%, or from 50% to 100%, or from 70% to 100% of the external surface of the pass of the radiant coil. If protuberances do not cover the entire coil pass, but cover less than 100% of the pass, they can be located at the bottom, middle or top of the pass.

A protuberance base is in contact with the external coil surface. A base of a protuberance has an area not larger than 0.1%-10% of the coil cross sectional area. The protuberance may have geometrical shape, having a relatively large external surface that contains a relatively small volume, such as for example tetrahedrons, pyramids, cubes, cones, a section through a sphere (e.g. hemispherical or less), a section through an ellipsoid, a section through a deformed ellipsoid (e.g. a tear drop) etc. Some useful shapes for a protuberance include:

a tetrahedron (pyramid with a triangular base and 3 faces that are equilateral triangles);

a Johnson square pyramid (pyramid with a square base and sides which are equilateral triangles);

a pyramid with 4 isosceles triangle sides;

a pyramid with isosceles triangle sides (e.g. if it's a four faced pyramid the base may not be a square it could be a rectangle or a parallelogram);

a section of a sphere (e.g. a hemi sphere or less);

a section of an ellipsoid (e.g. a section through the shape or volume formed when an ellipse is rotated through its major or minor axis); and a section of a tear drop (e.g. a section through the shape or volume formed when a non uniformly deformed ellipsoid is rotated along the axis of deformation);

a section of a parabola (e.g. section through the shape or volume formed when a parabola is rotated about its major axis—a deformed hemi—(or less) sphere), such as e.g. different types of delta-wings.

The selection of the shape of the protuberance is largely based on the ease of manufacturing the pass or tube. One method for forming protuberances on the pass is by casting in a mold having the shape of the protuberance in the mold wall. This is effective for relative simple shapes. The protuberances may also be produced by machining the external surface of a cast tube such as by the use of knurling device for example a knurl roll.

The above shapes are closed solids.

The size of the protuberance should be carefully selected. The smaller the size, the higher is the surface to volume ratio of a protuberance, but it may be more difficult to cast or machine such a texture. In addition, in the case of excessively small protuberances, the benefit of their presence may become gradually reduced with time due to settlement of different impurities on the coil surface. However, the protuberances need not be ideally symmetrical. For example an elliptical base could be deformed to a tear drop shape, and if so shaped preferably the "tail" may point down when the pass is positioned in the furnace.

A protuberance may have a height (LZ) above the surface of the radiant coil from 3% to 15% of the coil outer diameter, and all the ranges in between, for example, from 3% to 10% of the coil outer diameter.

In one embodiment, the concentration of the protuberances is uniform and covers completely the coil external surface. However, the concentration may also be selected based on the radiation flux at the location of the coil pass (e.g., some locations may have a higher flux than others—corners of the furnace).

In designing the protuberances, care should be taken so that they adsorb more radiant energy than they may radiate. This may be restated as the transfer of heat through the base of the protuberance into the coil must exceed that transferred to the equivalent surface on a bare finless coil at the same operational conditions. If the concentrations of the protuberances become excessive and if their geometry is not selected properly, they may start to reduce heat transfer, due to thermal effects of excessive conductive resistance, which defeats the purpose of the protuberance. The properly designed and manufactured protuberances will increase net radiative and convective heat transferred to a coil from surrounding flowing combustion gasses, flame and furnace refractory. Their positive impact on radiative heat transfer is not only because more heat can be absorbed through the increased coil external surface so the contact area between combustion gases and coil is increased, but also because the relative heat loss through the radiating coil surface is reduced, as the coil surface is not smooth any more. Accordingly, as a protuberance radiates energy to its surroundings, part of this energy is delivered to and captured by other protuberances, thus it is re-directed back to the coil surface. The protuberances will also increase the convective heat transfer to a coil, due to increase in coil external surface that is in contact with flowing combustion gas, but also by increasing turbulence along the coil surface and by reducing the thickness of a boundary layer.

In an alternate embodiment, the external surface of the pipe or furnace coil or pass may comprise one or more fins longitudinal fins. Pipes or tubes for furnace passes having external longitudinal fins are described for example in U.S. Pat. No. 9,132,409 issued Sep. 15, 2015 to Petela et al, assigned to NOVA Chemicals (International) S.A.

In accordance with this aspect, one or more longitudinal vertical fins are added to the external surface of the process coil, at least to a portion of one or more passes in the cracking furnace radiant section.

In some embodiments, there could be from 1 to 8, or from 1 to 4, or 1 or 2 longitudinal vertical fins, on the external surface of at least a portion of the coil single pass or, preferably, on more than one coil passes. If more than one fin is present, the fins may be radially evenly spaced about the outer circumference of the coil pass (e.g. two fins spaced 180° or four fins spaced 90° apart on the outer circumference of the coil pass). However, the fins spacing could be asymmetric. For example, for two fins the spacing could be from 160° to 200° radially apart on the external circumference of the radiant coil and two fins could be spaced from 60° to 120° radially apart.

The longitudinal vertical fins may have a number of cross sectional shapes, such as rectangular, square, triangular, trapezoidal, or a tapered rectangular profile thinner at its upper surface than the base. A trapezoidal shape may not be entirely intentional, but may arise from the manufacturing process, for example when it is too difficult or costly to manufacture (e.g. cast or machine) a triangular cross section.

The fins can extend from 10% to 100% (and all ranges in between) of the length of the coil pass. However, the length (Ln) of the fin and location of the fin need not be uniform along all of the coil passes. In some embodiments, the fin could extend from 15 to 100%, or from 30% to 100%, or from 50% to 100% of the length of the pass of the radiant coil and be located at the bottom, middle or top of the coil pass. In further embodiments the fin could extend from 15% to 95%, or from 25% to 85% of the length of the coil pass and be located centrally along the coil or be off set to the top or the bottom of the pass.

A fin may have at its base at the external circumference of the radiant coil, a width (Ls) from 3% to 30% of the coil outer diameter, or from about 6% to 25%, or from 7% to 20%, or from 7.5% to 15% of the coil outer diameter.

A fin may have a height (LZ) above the surface of the radiant coil from 10% to 50% of the coil outer diameter and all the ranges in between, for example, from 10% to 40%, or from 10% to 35% of the coil outer diameter. The fins placed along coil passes may not have identical sizes in all locations in the radiant section, as the size of the fin may be selected based on the radiation flux at the location of the coil pass (e.g. some locations may have a higher flux than others—of the furnace corners).

In designing the fin, care should be taken so that the fin adsorbs more radiant energy than it may radiate. This may be restated as the heat being transferred from the fin into the coil (through the base of the fin on the external surface of the coil) must be larger than the heat transferred through the same area on the surface of the bare finless coil. If the fin becomes too big (too high or too wide) the fin may start to reduce heat transfer, due to thermal effects of excessive conductive resistance (e.g., the fin radiates and gives away more heat than it absorbs), which defeats the purpose of the fin. Under the conditions of operation/use the transfer of heat through the base of the fin into the coil must exceed that transferred to the equivalent surface on a bare finless coil at the same conditions.

In a further embodiment, the fins are substantially thicker. In accordance with this embodiment, the fins will have a thickness at their base of not less than about 33% of the radius of the furnace tube, for example, about 40%, for example, not less than about 45%, in some embodiments up to 50% of the radius of the tube. The fins are thick or stubby. They have a height to maximum width ratio of from about 0.5 to about 5, or from 1 to 3. The sides (edges) of the fin may be parallel or be lightly tapered inward toward the external edge of the fin. The angle of taper should be no more than about 15°, for example, about 10° or less inward relative to the center line of the fin. The edge of the fin may be flat, pointed (at a 30° to 45° angle from each surface), or have a blunt rounded nose. The fins may have a cross section shape in the form of an outwardly extending parabola, parallelogram, of a blunt "V" shape In some cases, preferably for longitudinal fins, the fin cross section may be "E" shaped (monolith with parallel longitudinal extensions (having parallel grooves).

In one embodiment, at least one major surface of the fin has an array of outwardly open grooves in a regular or semi-regular pattern covering at least 10% of the surface area of at least one major surface of the fin (e.g. top or bottom for horizontal fins or sides for longitudinal fins), said grooves having a depth of less than a quarter, in some instances from a eighth to a tenth of the maximum thickness of the fin. The array may cover not less than 25%, in some cases not less than 50%, for example, greater than 75%, for example, greater than 85% up to 100% of the of the surface area of one or more the major surfaces of the fin. The array could be in the form of parallel lines, straight or wavy, parallel to or at an angle from the major axis of the fin, crossed lines, wavy lines, squares, or rectangles. The grooves may be in the form of an outwardly open V, a truncated outwardly open V, an outwardly open U, and an outwardly open parallel sided channel.

The fins may be transverse or parallel (e.g., longitudinal) to the major axis of the furnace tube. The transverse fins could be at an angle from about 0° to about 25° off perpendicular relative to the major axis of the furnace tube. However, it is more costly and difficult to make transvers fins at an angle off perpendicular to the major axis of the tube. The transverse fins may have a shape selected from a circle, an ellipse, or an N sided polygon where N is a whole number greater than or equal to 3. In some embodiments N is from 4 to 12. The major surface(s) for the transverse fins are the upper and bottom face of the fin. Transverse fins should be spaced apart at least two times in some instances from 3 to 5 times, the external diameter of the furnace tube.

The longitudinal fins may have a shape of a parallelogram, a part of an ellipse or circle and a length from about 50% of the length of the furnace tube (sometimes referred to pass) in the radiant section up to 100% of the length of the furnace tube in the radiant section and all ranges in between.

The base of the longitudinal fin may be not less than one quarter of the radius of the furnace tube, in some instances from ¼ to ¾, or from about ⅓ to ¾ or in some instances ⅓ to ⅝ in other instances from ⅓ to ½ of the radius of the furnace tube. The fins are thick or stubby. They have a ratio of height to maximum width of from about 0.5 to about 5, or 1 to 3. The sides (edges) of the fin may be parallel or be lightly tapered inward toward the tip of the fin. In some embodiments, the angle of taper is no more than about 15°, for example, about 10° or less inward relative to the center line of the fin. The tip or leading edge of the fin may be flat, tapered (at a 30° to 45° angle from the top and bottom surfaces of the fin), or have a blunt rounded nose. The leading edge of the longitudinal fin will typically be parallel to the central axis of the furnace tube. In cases where the fin extends less than 100% of the length of the furnace tube the leading edge of the fin will for the most part be parallel to the central axis of the furnace tube and then angle in to the furnace tube wall at an angle between about 60° and 30°, for example, 45°. In some case the fin may end in a flat surface perpendicular to the surface of the tube.

The present invention will now be illustrated by the following non limiting example.

A new stainless steel base alloy formulation was designed for the purpose of generating a protective coating layer that prevents catalytic coke growth and the deposition on its surface of fouling material when used in an ethane cracking furnace. The alloy composition (wt. %) is presented in Table 1 and compared with previous state of the art product. The new formulation contains Lanthanum and Cerium. Another variation may contain only Lanthanum.

TABLE 1

| Sample (Mass %) | C | Si | Mn | Ni | Cr | Mo | Nb | Ti | La | Ce |
|---|---|---|---|---|---|---|---|---|---|---|
| State of the art | 0.4/0.6 | 2.0 max. | 2.0 max. | 40/60 | 30/35 | | 0.5/1.8 | | | |
| New | 0.46 | 1.20 | 1.36 | 43.04 | 31.79 | 0.09 | 0.82 | 0.14 | 0.24 | 0.62 |

The state of the art steel and the new steel were formed into furnace tubes to be used in the radiant section of a steam cracking furnace. The tubes were subject to a thermal treatment as described above to generate a low coking surface on the interior of the tube.

The oxide film coverage on the internal surface of the pipe made with the steel of this disclosure was measured quantitatively using imaging analysis software. The shielding oxide layer surface coverage varied between 99.7% and 100%. After life in operation (5-6 years) in one of NOVA Chemicals Corporation steam crackers, the oxide surface coverage is still 99% as calculated using the same technique. This enhanced surface oxide stability and protection characterized by the lack of the oxide layer spalling is a feature of this new formulation.

SEM-EDX analysis of the cross-section showed that the total oxide layer didn't exceed 3.5 μm. This layer was made of a top spinel ($MnCr_2O_4$) layer varying between 1.5 and 2.0 μm thick and a thinner bottom $Cr_2O_3$ layer varying between 1.0 and 1.7 μm thick. The maximum oxide layer thickness of this new formulation was 3.5 μm compared to the state of the art steel which is 10 μm.

After testing the new steel formulation at 1100° C. in an oxidizing environment for 100 hours the oxide layer thickness increased from 3.5 to 10 μm compared to the state of the art steel which increased from 10 to 42 μm.

After 5 years in commercial operation, the shielding oxide layer was still intact as demonstrated by an SEM-EDX cross-section analysis of a coil removed from one of NOVA Chemicals Corporation steam crackers (FIG. 1).

SEM's were taken of the cross section of the outlet coil confirmed the presence of a continuous uniform layer high in oxygen, chrome, and Manganese concentration forming the shielding oxide layer. EDX analysis also confirmed the absence of iron and nickel in the shielding oxide top layer. The surface oxide layer is stable under conventional use in a steam cracker and does not spall.

This new steel substrate formulation is designed so that there is a controlled/limited growth in the crystallite size covering the surface which enhances the oxide surface stability, generates a more compact surface and increases the oxide surface robustness.

Crystallite size in previous state of the art ANK400H increased from 0.5 to 5-10 μm upon exposure to oxidation testing at 1100° C. for 100 hours. The new formulation subjected to the same testing conditions increase only from 0.5 to 3 μm.

Figure 2:
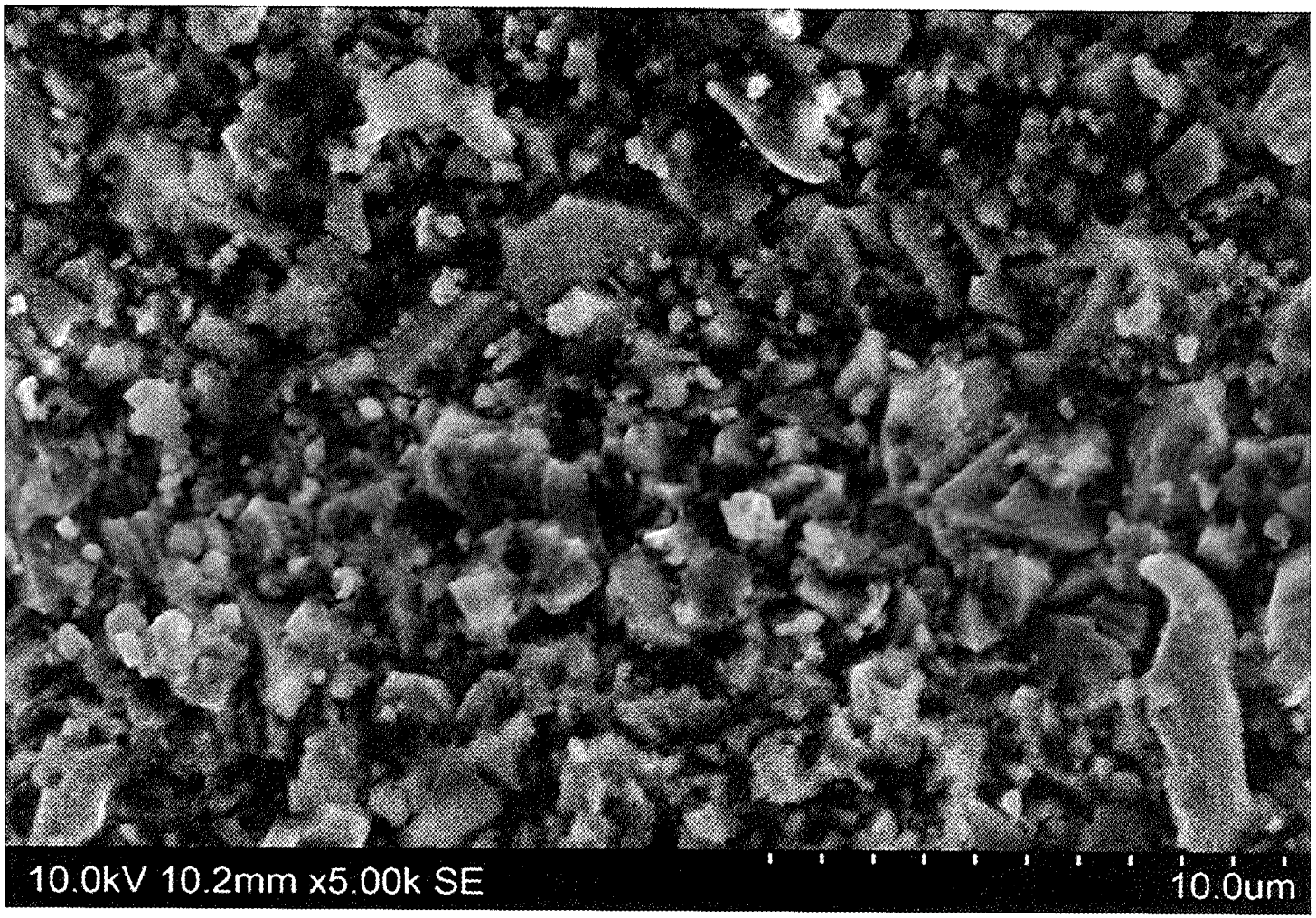
FIG. 2 is a SEM of a section at the inlet tube to the hot box of an ethane cracking furnace. The radiant section of the furnace has 2 compartments called cold box and a hot box.

After life in operation the crystallite size did not grow in size as depicted in FIG. 2, thus providing a reliable surface protection and confirming the effectiveness of the control of the crystallite size.

What is claimed is:

1. A steel substrate comprising from 40 to 55 wt. % Ni, from 30 to 35 wt. % of Cr, from 15 to 25 wt. % Fe, from 1.0 to 2.0 wt. % of Mn, from 0.01 to 0.60 wt. % of La, from 0.0 to 0.65 wt. % of Ce; from 0.06 to 1.8 wt. % of Nb and one or more trace elements and carbon and silicon having on its surface an outer layer comprising a spinel of the formula:

$$Mn_xCr_{3-x}O_4$$

wherein x is from 0.5 to 2 having a thickness from 1.5 to 4.0 microns thick and an intermediate layer between the surface layer and the substrate comprising $Cr_2O_3$ having a thickness from 1 to 1.7 microns.

2. The steel substrate according to claim 1, further comprising from 0.4 to 0.6 wt. % C, less than 1.5 wt. % Si, from 0.01 to 0.20 wt. % of Ti, from 0.05 to 0.25 wt. % of Mo, and less than 0.25 wt. % Cu.

3. The steel substrate according to claim 2, wherein the outer layer and the intermediate layer cover not less than 85% of the surface of the substrate layer.

4. The steel substrate according to claim 3, wherein the outer layer and the intermediate layer cover not less than 95% of the surface of the substrate layer.

5. The steel substrate according to claim 4, wherein in the outer layer x has a thickness from 0.8 to 1.2 microns.

6. The steel substrate according to claim 5, wherein the outer layer has a thickness from 1.5 to 2.0 microns and the intermediate layer has a thickness from 1.0 to 1.7 microns.

7. The steel substrate according to claim 6, wherein the outer layer consists essentially of $MnCr_2O_4$.

8. A fabricated part comprising the steel substrate of claim 1, having at least one surface having the outer and intermediate layer.

9. A fabricated part according to claim 8 which is a tube having the outer and intermediate layer on its internal surface.

10. A fabricated part according to claim 8 which is a reactor having the outer and intermediate layer on its internal surface.

11. A tube according to claim 8 further comprising on its internal surface one or more continuous or discontinuous beads or fins wherein angle of intersection of the fins or beads with the longitudinal tube axis is theta (θ), at a pitch (p) of the fins at S the circumference (S=nD where D is the inside diameter of the tube).

12. A furnace tube according to claim 9, having on its external surface a series of closed protuberances having i) a maximum height from 3 to 15% of the coil outer diameter;

ii) a contact surface with a coil, or a base, which area is 0.1%-10% of the coil external cross section area;

iii) a geometrical shape which has a relatively large external surface containing a relatively small volume, chosen from a tetrahedron;
a Johnson square pyramid;
a pyramid with 4 isosceles triangle sides;
a pyramid with isosceles triangle sides;
a section of a sphere;
a section of an ellipsoid;
a section of a tear drop;
a section of a parabola.

13. A furnace tube according to claim 11, having on its external surface a series of closed protuberances having i) a maximum height from 3 to 15% of the coil outer diameter;

ii) a contact surface with a coil, or a base, which area is 0.1%-10% of the coil external cross section area;

iii) a geometrical shape which has a relatively large external surface containing a relatively small volume, chosen from a tetrahedron;

a Johnson square pyramid;
a pyramid with 4 isosceles triangle sides;
a pyramid with isosceles triangle sides;
a section of a sphere;
a section of an ellipsoid;
a section of a tear drop;
a section of a parabola.

14. A furnace tube according to claim 9, having a circular cross section and having on its external surface from 1 to 8 substantially linear longitudinal vertical fins having a triangular cross section said fins having: (i) a length from 10 to 100% of the length of the coil pass; (ii) a base having a width from 3% to 30% of the coil outer diameter, which base has continuous contact with, or is integrally part of the coil pass; (iii) a height from 10% to 50% of the coil outer diameter; (v) a weight from 3% to 45% of the total weight of the coil pass; and (vi) adsorbing more radiant energy than they radiate.

15. A furnace tube according to claim 11, having a circular cross section and on its external surface from 1 to 8 substantially linear longitudinal vertical fins having a triangular cross section said fins having: (i) a length from 10 to 100% of the length of the coil pass; (ii) a base having a width from 3% to 30% of the coil outer diameter, which base has continuous contact with, or is integrally part of the coil pass; (iii) a height from 10% to 50% of the coil outer diameter; (v) a weight from 3% to 45% of the total weight of the coil pass; and (vi) adsorbing more radiant energy than they radiate.

16. A tube according to claim 11, wherein the internal beads or fins are continuous.

17. A tube according to claim 11, wherein the internal beads or fins are discontinuous.

18. A tube according to claim 11, wherein the internal beads or fins are discontinuous and the total circular arc length of the fin(s) is TW=wxn where w is the circular arc length projected on a plane and n is the number of fins on one turn of the helical line.

* * * * *